United States Patent [19]

Brozille

[11] 4,216,358

[45] Aug. 5, 1980

[54] SNAP SWITCH

[75] Inventor: Jean-Yves Brozille, Valence, France

[73] Assignee: Crouzet, Paris, France

[21] Appl. No.: 957,055

[22] Filed: Nov. 3, 1978

[30] Foreign Application Priority Data

Nov. 8, 1977 [FR] France ..... 77 33681

[51] Int. Cl.[2] ..... H01H 1/14; H01H 5/26

[52] U.S. Cl. ..... 200/67 D; 200/76; 200/240; 200/284; 200/DIG. 42

[58] Field of Search ..... 200/67 A, 67 D, 67 PK, 200/76, 240, 241, 243, 284, DIG. 42

[56] References Cited

U.S. PATENT DOCUMENTS

| | | | |
|---|---|---|---|
| 2,400,754 | 5/1946 | Hausler | 200/67 D |
| 2,598,856 | 6/1952 | Swan et al. | 200/67 D |
| 2,773,144 | 12/1956 | Immel et al. | 200/67 D |
| 3,967,081 | 6/1976 | Portmann et al. | 200/76 X |

FOREIGN PATENT DOCUMENTS

| | | | |
|---|---|---|---|
| 1935225 | 2/1971 | Fed. Rep. of Germany | 200/76 |
| 2228096 | 12/1973 | Fed. Rep. of Germany | 200/76 |
| 2653001 | 5/1977 | Fed. Rep. of Germany | 200/67 D |

*Primary Examiner*—Stephen Marcus

*Attorney, Agent, or Firm*—Jacobs & Jacobs

[57] ABSTRACT

A snap switch comprises a control button, a control rod slidable with the control button via a spring, two pairs of contacts associated, respectively, with two pairs of terminals, the two contacts of each pair of contacts being connectable by resilient conducting means under the action of a setting spring fixed to the control rod and to these resilient conducting means. The two contacts of one pair of contacts are borne by two pivotable conducting plates, biased by resilient means for connecting the two contacts borne by the conducting plates to their respective terminals. The conducting plates can be pivoted under the action of the control button and against the action of the resilient biasing means for disconnecting the two contacts borne by the conducting plates from their respective terminals.

2 Claims, 3 Drawing Figures

SNAP SWITCH

BACKGROUND OF THE INVENTION

The present invention relates to a snap switch, or so-called "positive safety" switch, wherein a greater pressure on the control button of the switch necessarily switches off the electric circuit.

The invention relates more particularly to a snap switch, comprising a control button, a control rod slidable with the control button via a spring, two pairs of contacts associated, respectively, with two pairs of terminals, the two contacts of each pair of contacts being connectable by resilient conducting means under the action of a setting spring fixed to the control rod and to these means, the two contacts of one pair of contacts being able to be electrically disconnected from their respective terminals by the control button when it is pushed in completely against the action of the spring of the control rod.

Such a switch is described, as a whole, in German Pat. No. 2 551 873 (FIG. 1), German Pat. No. 2 551 858 (FIG. 1 ) and in British Pat. No. 1 114 630 (FIGS. 1 and 2).

However, although these latter switches enable the electric circuit to be switched off when the main contacts are welded, they present the drawback of not necessarily being able to return these main contacts into working order, in the case of these latter adhering only by microwelds further to an electric arc.

SUMMARY OF THE INVENTION

It is therefore an object of the present invention to provide a switch of the above type, in which possible microwelds may be broken.

To this end, the present invention relates to a switch of the above mentioned type wherein the two contacts of one pair of contacts are borne, respectively, by two conducting plates mounted to pivot in the switch under the action of the control button and against the action of resilient biasing means tending to connect electrically the said two contacts to their respective terminals.

Due to the arrangement of the invention, the contacts may be driven in a movement of rotation and roll on one another, this resulting in the desired breaking of the possible microwelds.

The invention will be more readily understood on reading the following description with reference to the accompanying drawing.

DESCRIPTION OF THE PREFERRED EMBODIMENT

Figure 1:
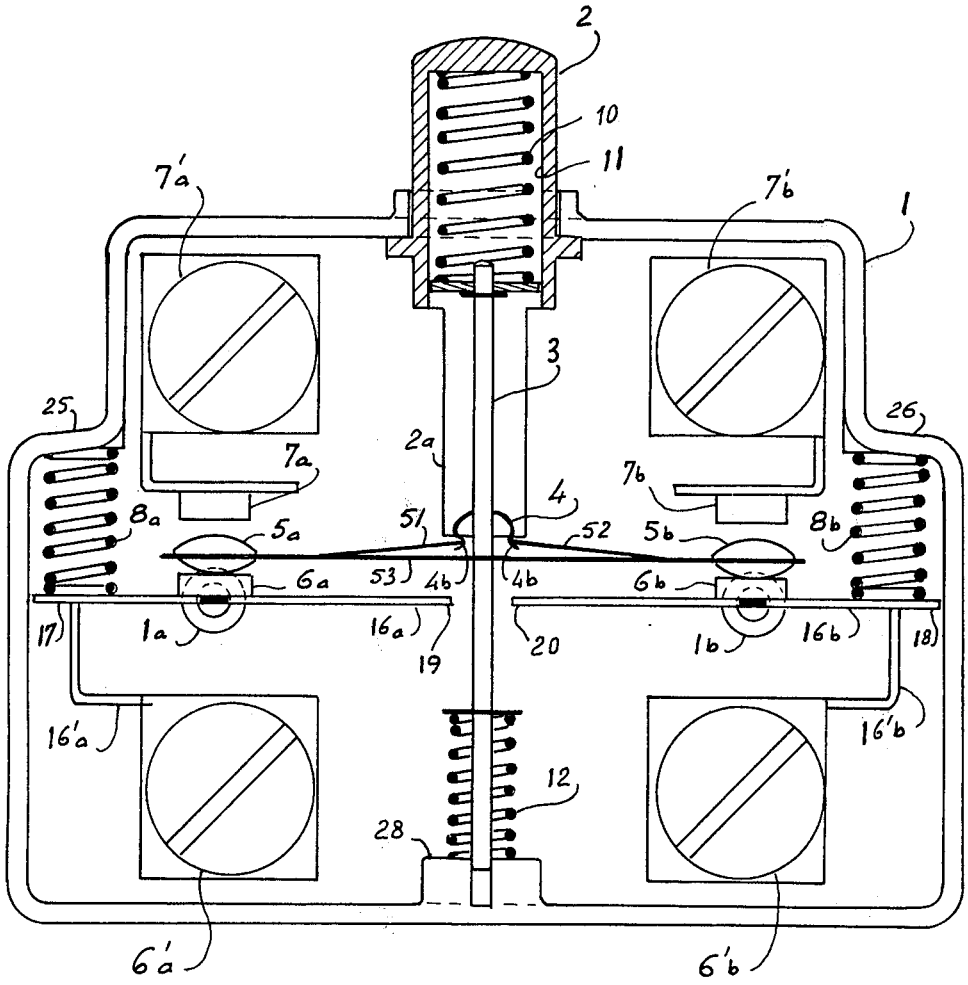
FIG. 1 is a schematic view in section of the switch according to the invention, in rest position.

Referring now to the drawing, the switch according to the invention comprises a box 1 made of insulating material, in which are assembled, in known manner, a control button 2, a control rod 3 slidable with the button 2 via a spring 10, housed in a recess 11 made in the button 2. A setting spring 4, connected to the rod 3, is fixed, by its two ends 4*a* and 4*b*, to resilient conducting means formed by two portions 51, 52 of elastic plate which are themselves fixed, in known manner, to an electrical connection conducting frame 53. This frame 53 bears two electrical contacts 5*a* and 5*b*. A downward action on the button 2 in the direction of arrow F of FIG. 2 causes the rod 3 to move in translation, and the spring 4 causes the portions of resilient plate 51 and 52 to be thrown on the other side of the frame 53 which, by the elasticity of these portions of resilient plate, is biased upwardly, i.e. towards the contacts 7*a* and 7*b*.

The box 1 comprises a pair of normally open contacts 7*a*, 7*b* and a pair of normally closed contacts 6*a*, 6*b*, associated respectively with two pairs of terminals 7'*a*, 7'*b* and 6'*a*, 6'*b*, the pair of contacts 6*a* and 6*b* being the more remote from the control button 2.

Figure 2:
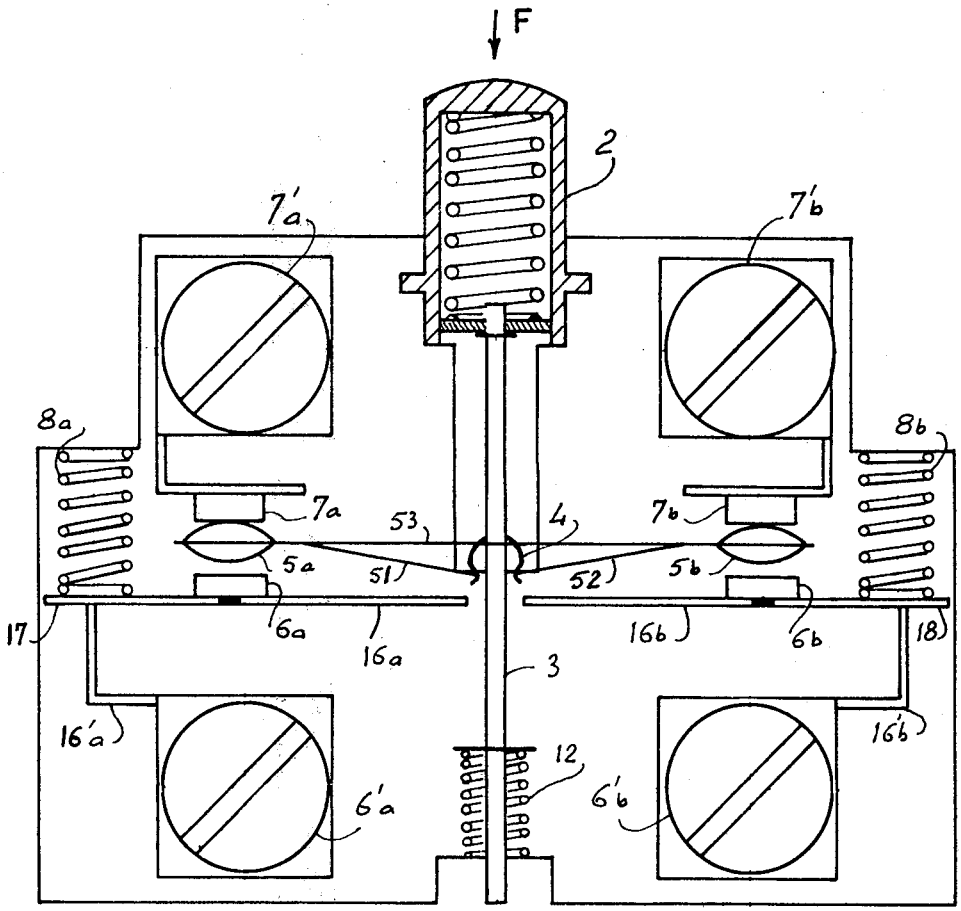
FIG. 2 is a schematic view in section of the switch of FIG. 1, after normal reversal of the contacts.

According to the action exerted in the direction of arrow F (FIGS. 2 and 3) on the control button 2, against the action of a biasing spring 12, in abutment against a boss 28 of the box 1, and consequently according to the stroke in the box 1 of the control rod 3 slidable with the button 2, the contacts 5*a* and 5*b*, via the setting spring 4, the portions of resilient plate 51 and 52, and the frame 53, may be pressed, in a first position, on the contacts 6*a* and 6*b* (FIG. 1) and, in a second position, on contacts 7*a* and 7*b* (FIG. 2).

In the first position defined hereinabove, the two contacts 6*a* and 6*b* are connected by the conducting frame 53 and the contacts 5*a* and 5*b*, and, in the second position, the contacts 7*a* and 7*b* are connected by the frame 53 and the contacts 5*a* and 5*b*.

The two contacts 6*a* and 6*b* of the pair of contacts more remote from the control button 2 are borne respectively by two conducting plates 16*a* and 16*b* arranged to pivot in the switch of the invention under the action of an extension 2*a* of the control button 2, and against the action of two biasing springs 8*a* and 8*b* tending to connect electrically the two contacts 6*a* and 6*b* to their respective terminals 6'*a* and 6'*b* via the two conducting plates 16*a* and 16*b* and two conducting elements 16'*a* and 16'*b*,as will be described hereinafter.

As shown in the Figures, the two plates 16*a* and 16*b* are pivotally mounted in cavities made in bosses 1*a* and 1*b* formed by moulding in the walls of the box 1. The contacts 6*a* and 6*b* are respectively disposed on the pivoting axes of the plates 16*a* and 16*b*, at the level of bosses 1*a* and 1*b*.

In normal position, the springs 8*a* and 8*b*, in abutment against shoulders 25 and 26 of the box 1, act on the ends 17 and 18 of the plates 16*a* and 16*b* to maintain them in abutment on the conducting elements 16'*a* and 16'*b* electrically connected to the terminals 6'*a* and 6'*b*.

Figure 3:
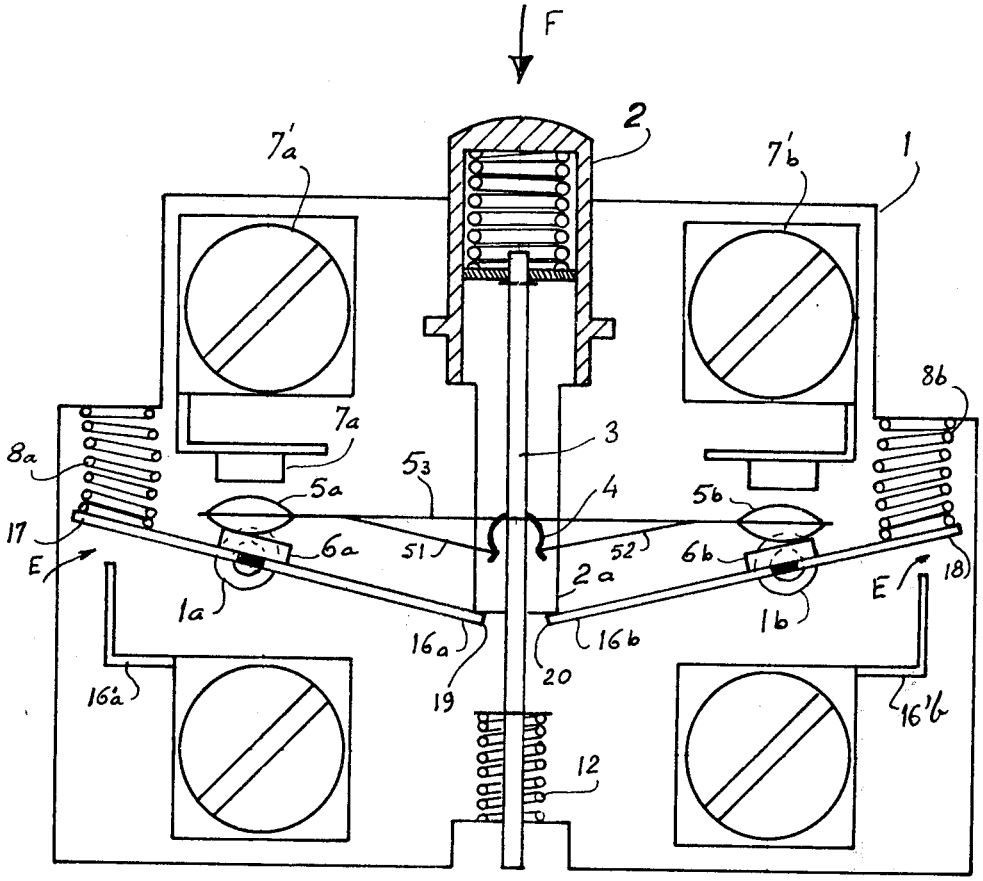
FIG. 3 is a schematic view in section of the switch of FIGS. 1 and 2, in positive safety position.

If, for example due to an electric arc, the or each contact 5*a* and 5*b* remains stuck on the or each contact 6*a* and 6*b* (FIG. 3), it suffices to push the control button in completely, in the direction of arrow F, so that its extension 2*a*, acting on the ends 19 and 20 of the plates 16*a* and 16*b*, respectively, provokes the interruption of the electric circuit by causing the plates 16*a* and 16*b* to pivot, this having for its effect to disconnect the ends 17 and 18 of these plates from the conducting elements 16'*a* and 16'*b*, by creating gaps E (FIG. 3).

Furthermore, the contacts 6*a* and 6*b* being disposed on the pivoting axes of the plates 16*a* and 16*b*, the contacts 5*a* and 6*a*, on the one hand, and the contacts 5*b* and 6*b*, on the other hand, can roll on one another, this promoting the breaking of possible microwelds.

The switch according to the invention thus described and illustrated is particularly suitable for use in industrial automatic apparatus.

What I claim is:

1. A snap, switch, comprising a control button, a spring, a control rod slidable with the control button via said spring, first and second pairs of contacts, first and second pairs of terminals associated with said first and second pairs of contacts, respectively, resilient conducting means, a setting spring fixed to said control rod and to said resilient conducting means, the two contacts of each pair of contacts being connectable by said resilient conducting means under the action of said setting spring, the two contacts of the first pair of contacts being able to be electrically disconnected from their respective terminals by said control button when it is pushed in completely against the action of said spring of said control rod, two conducting plates pivotally mounted in the switch, each of said conducting plates bearing one of the two contacts of the first pair of contacts and resilient means for biasing said conducting plates toward said first pair of terminals and thus connecting electrically said first pair of contacts to first pair of terminals, whereby said conducting plates can be pivoted under the action of said control button and against the action of said resilient biasing means for electrically disconnecting said first pair contacts from their respective terminals.

2. A switch as claimed in claim 1, wherein said two contacts of the first pair of contacts are each disposed on the pivoting axis of said pivotable conducting plates.

* * * * *